United States Patent [19]

Forbes, Jr.

[11] Patent Number: 4,616,751

[45] Date of Patent: Oct. 14, 1986

[54] SLEEVE FOR PROMOTIONAL PRODUCTS

[75] Inventor: Hampton E. Forbes, Jr., Wilmington, Del.

[73] Assignee: Westvaco Corporation, New York, N.Y.

[21] Appl. No.: 416,643

[22] Filed: Sep. 10, 1982

[51] Int. Cl.[4] ..... B65D 73/00

[52] U.S. Cl. ..... 206/485; 206/349

[58] Field of Search ..... 206/58, 485, 349, 216

[56] References Cited

U.S. PATENT DOCUMENTS

| | | | |
|---|---|---|---|
| 1,179,056 | 4/1916 | Walsh | 206/216 |
| 2,491,680 | 12/1949 | Meyerhoefer | 206/349 |
| 2,939,577 | 6/1960 | Cunnien | 206/216 |
| 3,054,505 | 9/1962 | Hennessey | 206/216 |
| 3,393,076 | 7/1968 | Moyer et al. | 206/485 |
| 4,141,448 | 2/1979 | Mascia et al. | 206/485 |

FOREIGN PATENT DOCUMENTS

| | | | |
|---|---|---|---|
| 2324844 | 5/1973 | Fed. Rep. of Germany | 206/216 |

*Primary Examiner*—Joseph Man-Fu Moy

[57] ABSTRACT

A display sleeve adapted to be slid over the flanged lid of a primary container or the like wherein the sleeve element may support one or more promotional products to be sold with the primary product. The sleeve may be constructed from paper or paperboard and it includes slots on opposed side thereof for effectively gripping the flange portion of the primary container lid.

5 Claims, 12 Drawing Figures

SLEEVE FOR PROMOTIONAL PRODUCTS

BACKGROUND OF INVENTION

The present invention relates to packaging and merchandising, and more particularly to a paper or paperboard sleeve element which fits over the flanged lid of a round can or the like. In this condition, the sleeve is arranged to support one or more promotional products sold with the primary product packaged in the can.

At the present time, many different techniques are used to market products at the retail level. The incorporation of promotional items with the primary product is but one method generally practiced. In many cases, the promotional item is a related product manufactured by the same manufacturer, and quite often, the promotional item is one that is being newly introduced to the marketplace. The promotional product or products may be packaged with the primary product in the same container, or in a separate container attached to the primary product container. For these purposes, it is well known in the art to provide such containers with separate compartments for each product.

In addition, one of the requirements for such packaging is to make the container substantially pilfer proof so that the promotional product cannot readily be separated from the primary product inadvertently or on purpose. Another requirement of such packages is that the combination primary product and promotional product be presented in a stylish and attractive manner in order to achieve maximum sales appeal.

SUMMARY OF THE INVENTION

In accordance with the present invention, a display sleeve element is provided which is adapted to be slid over the flanged lid of a round can or the like wherein the sleeve element may support one or more promotional products sold with the primary product. The flanged lid is typical of those normally found on aerosol cans or other primary product containers prepared from metal, plastic or a composite of metal, plastic and paperboard material. Meanwhile, the sleeve element may be prepared from paper, paperboard or other flexible material so that it is relatively low in cost.

The sleeve element is formed from a single blank of material that is cut and scored to provide at least two opposed elongated panels and a glue flap. In addition, the panels include locking slots in each of the opposed panels which engage the flanges of the can lid. Where desired, additional scores may be added to the blank to provide additional panels at one or both ends of the sleeve depending upon the size, number and shape of the promotional items added to the package. The sleeves are initially formed by adhering the glue flap attached to one elongated panel to the end of the other elongated panel. The sleeves are then maintained in a substantially flat condition until they are ready for use.

Since the sleeves in their unused condition are substantially flat and rectangular in shape, and the containers and lids with which they are used are generally round, each elongated panel and additional panel where used must be slightly longer than one-half the diameter of the flanged lid in order to fit around the lid and flange. Thus when the sleeves are opened to slide around each respective lid, spaces are created at each end of the sleeve between the container lid and the ends of the sleeve for accomodating and holding one or more promotional items in place. Subsequently, with the sleeve locked into position on the can lid flange or shoulder, the promotional product or products are firmly fixed in place with the use of a suitable heat shrinkable overwrap or band.

Accordingly, it is an object of the present invention to provide a sleeve for a can or the like having a flanged lid wherein the sleeve supports and retains in place promotional products sold with the can.

It is another object to provide such a sleeve which may be made from paper or paperboard utilizing conventional manufacturing techniques, so that the sleeve may be relatively low in cost as compared with the cost of providing a separate package for the promotional product.

It is yet another object of the present invention to provide such a sleeve with a convenient and reliable integral locking means for securing the sleeve to the flange or shoulder portion of the can lid.

It is a further object to provide a combination package for a primary product and promotional product which is attractive and distinctive so as to produce maximum sales appeal with protection against pilferage.

These and other objectives of the present invention will become apparent from the following detailed description and accompanying drawings.

DETAILED DESCRIPTION

Figure 1:
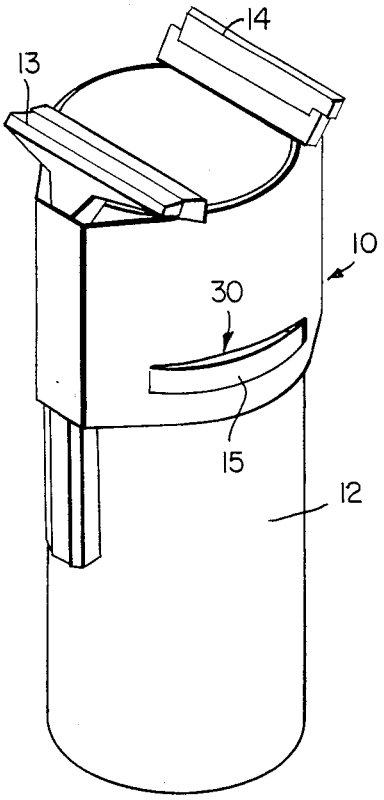
FIG. 1 is a perspective view of the combination can and sleeve showing the promotional products in place.

As illustrated in FIG. 1, the sleeve element 10 of the present invention is fitted to the flanged lid 11 of a typical aerosol can 12. The sleeve 10 in this position serves to support a pair of promotional items 13,14 in place adjacent to the can 12.

Figure 2:
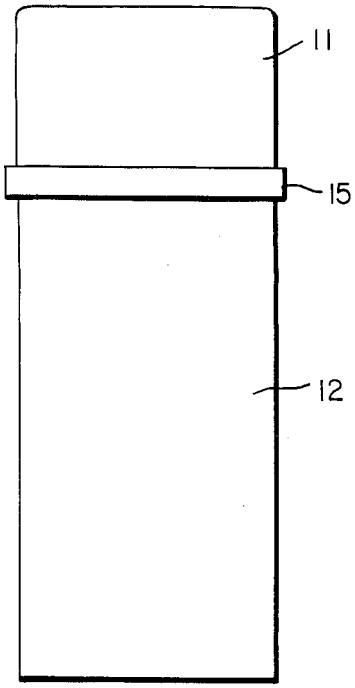
FIG. 2 illustrates a typical aerosol can with flanged lid for which the invention is intended.
Figure 7:
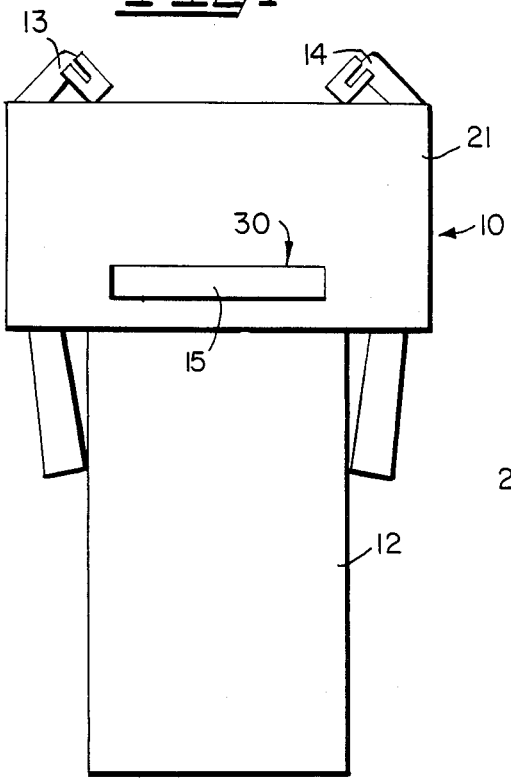
FIG. 7 is a side view of the combination can and sleeve showing the promotional products in place.

FIG. 2 shows the basic construction of a typical aerosol can around which the sleeve of the present invention is used. The can 12 includes a lid 11 with an integral flange portion 15. The flange 15 is in the form of a lip or shoulder around the outer periphery of the lid 11 and serves as the part of the lid to which the sleeve may be locked. Referring once again to FIG. 1 and to FIGS. 7 and 8, the sleeve 10 includes a pair of slots 30,31 through which the flange 15 protrudes to lock the sleeve on the cap. In this manner, with the sleeve 10 effectively locked in position on the lid 11, the promotional products 13,14 may be inserted in the space between the can and sleeve at each side of the can where they are supported and held in place.

Figure 3:
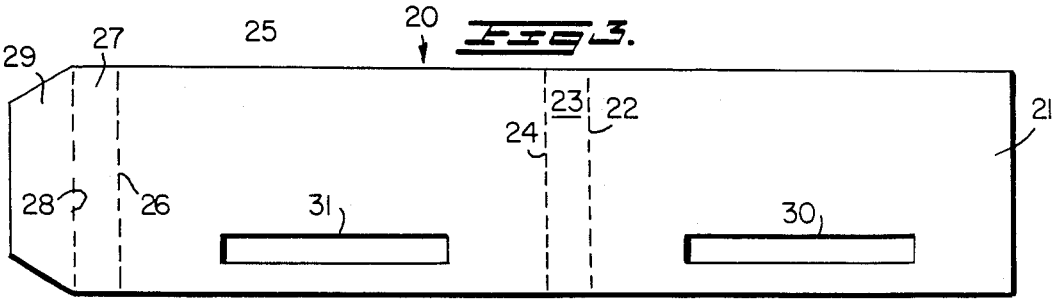
FIG. 3 is a plan view of the preferred blank structure for making the sleeve of the present invention.

The sleeve 10 may be made from a blank of paper or paperboard or the like 20 as shown in FIG. 3. The blank is die cut and scored to provide a first full size rectangular panel 21, an abbreviated end panel 23, a second full size rectangular panel 25, a second abbreviated end panel 27 and a glue flap 29 separated from one another by fold lines 22,24 26 and 28. Each of the full size rectangular panels 21 and 25 include locking slots 30,31 respectively of about the same size and shape as the flanges 15 on the can lid 11. The locking slots 30,31 are elongated and extend over a major portion of the length of the rectangular panels but do not extend full length. The slots 30,31 are located near the bottom of the rectangular panels 21,25 and the height of all panels is preferably slightly greater than the nominal height of the can lid 11. Meanwhile, the length of the abbreviated panels 23,27 is only a fraction of the total length of the main rectangular panels 21,25 and is dependent upon the size of the promotional products to be packaged. In each instance, the length of the full size rectangular panels must be slightly longer than one-half the diameter of the flanged lid in order that the sleeve might fit around the lid and flange.

Figure 4:
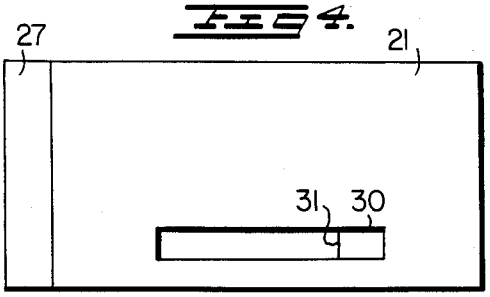
FIG. 4 is a side view of the blank of FIG. 3 folded and glued into its sleeve form but in a flattened condition.
Figure 5:
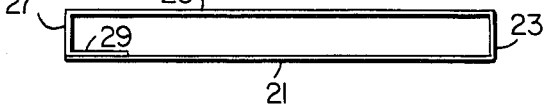
FIG. 5 is a top view of the sleeve of FIG. 4 after being squared.
Figure 6:
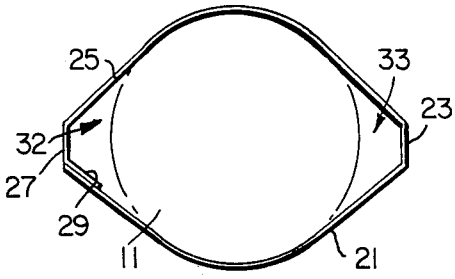
FIG. 6 is a top view of the sleeve in its elliptical shape around a typical can lid shown in dotted lines.
Figure 8:
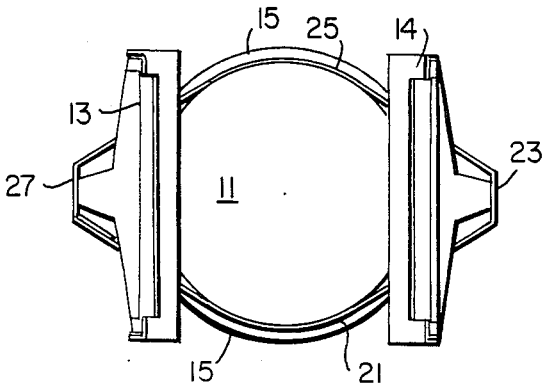
FIG. 8 is a top view of the combination can and sleeve shown in FIG. 7.

FIG. 4 illustrates the blank 20 folded and glued in its flat condition. For this purpose, the blank is folded first along score line 26, adhesive is applied to the glue flap 29 and the blank is folded again along score line 22 to adhere the end of panel 21 to glue flap 29. These steps produce a folded and glued sleeve ready for shipment to the user. For use, the sleeve is initially squared as shown in FIG. 5 and then the abbreviated end panels 23,27 are pressed inwardly to produce an elliptical shape as shown in FIGS. 6 and 8. In this condition, the sleeve is slid over the cap 11 of a can or the like and is positioned so that portions of the cap flange 15 protrude through the slots 30,31 to effectively lock the sleeve 10 in place. At this point, as shown in FIG. 6, spaces 32,33 are created at each end of the sleeve 10 between the can and the abbreviated end panels 23,27. These spaces accommodate the promotional products sold with the primary produce in the can.

Figure 9:
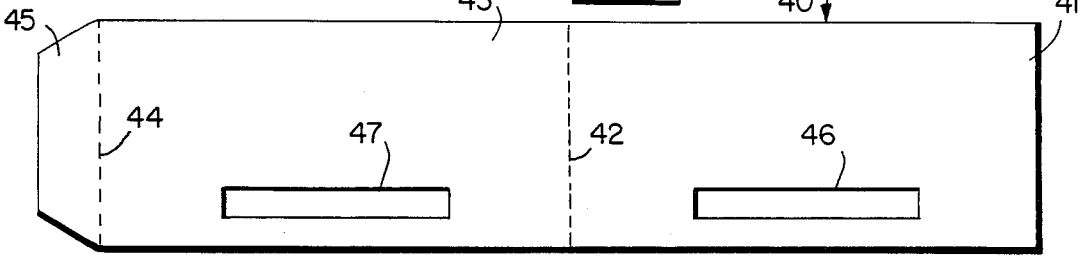
FIG. 9 is a plan view of a modified blank structure for the sleeve of the present invention.
Figure 10:
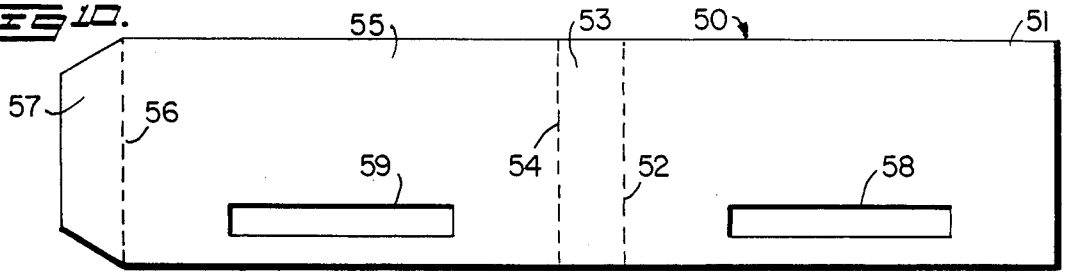
FIG. 10 is a plan view of a second modified blank structure for the sleeve of the present invention.
Figure 11:
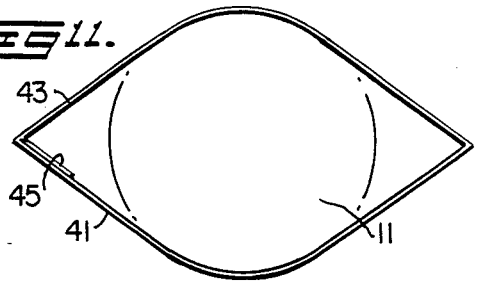
FIG. 11 is a top view of the sleeve of FIG. 9 positioned around a typical can lid shown in dotted lines; and, FIG. 12 is a top view of the sleeve of FIG. 10 positioned around a typical can lid shown in dotted lines.
Figure 12:
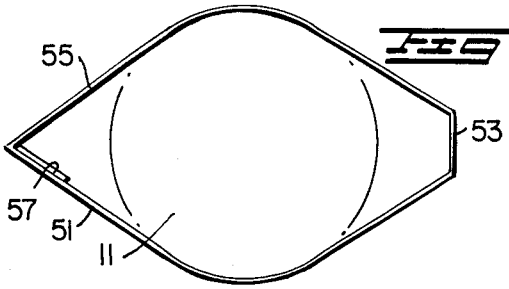

FIGS. 9–12 illustrate modified blanks for the sleeve structure. In FIG. 9, the blank 40 consists of a first main rectangular panel 41, a second main rectangular panel 43 and a glue flap 45 separated from one another by score lines 42,44. The main rectangular panels 41,43 each include locking slots 46,47 for securing the formed sleeve on the lid flange 15. The sleeve is formed by folding the blank at the score lines 42,44 and adhering the glue flap 45 to the panel 41. In this condition, the sleeve may be slid over a can lid 11 substantially as shown in FIG. 11. FIG. 10 shows another form of the blank which includes main rectangular panels 51,55 separated by score lines 52,54 which form a single abbreviated panel 53. Meanwhile, the blank includes a glue flap 57 foldably attached to main panel 55 along score line 56 and each main panel 51,55 includes locking slots 58,59. The sleeve is formed by folding the blank over about one of the score lines 52,54 and adhering glue flap 57 to main panel 51. In this instance, the sleeve assumes a shape substantially as shown in FIG. 12 when the sleeve is slid over the cap 11 of a can 12.

It is anticipated that the sleeve element of the present invention could be used with other containers of different shape as long as the containers or their lids include a flanged shoulder portion to cooperate with the locking slots provided in the sleeve. In addition, depending upon the size of the primary container employed, it is anticipated that there might be a need to divide the main rectangular panels into several segments. However, in any such modification, the area of the sleeve in which the locking slots are located would have to remain undisturbed in order to permit the flange to protrude therethrough. Thus, while the details of construction may be varied, it is desired that the invention be limited only by the appended claims.

I claim

1. In combination, a primary container and a display sleeve telescoped over and extending around said primary container said primary container comprising a can and lid of generally round configuration in cross section and adapted to be disposed in an upright manner, said lid including a peripheral flange located near an end thereof and spaced from the top of the lid, and a display sleeve of generally elliptical configuration in cross section, formed from a single blank of foldable material and comprising at least two elongated main penels of substantially rectangular shape and a glue flap foldably attached to one main panel and adhered to the end of the other main panel, the height of all panels of said display sleeve being greater than the nominal height of said primary container lid, said display sleeve including at least one pair of locking slots located in the main panels near the lower edges thereof, said locking slots extending over a major portion of the length of said main panels and having a width dimension substantially equal to the width of said primary container lid flange, wherein with the display sleeve telescoped over said primary container lid, said locking slots become engaged with said peripheral flange to retain said display sleeve on said primary container, and spaces are formed at each end of said display sleeve between the generally round edges of said primary container lid portion and the ends of the elliptically shaped display sleeve for accomodating and retaining one or more promotional products with said primary container.

2. The combination of claim 1 wherein said display sleeve includes at least one abbreviated panel located between said elongated main panels and is foldably attached thereto.

3. The combination of claim 2 wherein said display sleeve includes an additional abbreviated panel located between one of said main panels and said glue flap and is foldably attached thereto.

4. A display package comprising a sleeve element formed from a single blank of material, said blank initially comprising a generally rectangular strip of foldable paperboard or the like that is cut and scored to provide at least two elongated main panels foldably attached together, a glue flap foldably attached to one of said main panels and a pair of elongated locking slots formed within the length of said main panels and located near the lower edges thereof, said blank when folded and glued providing a substantially flat structure capable of being opened to an elliptically shaped cross sectional form and slid over, so as to extend around, the lid portion of a primary container of generally round configuration in cross section, said primary container and sleeve being adapted to be disposed in a generally upright condition, said lid portion including a peripheral flange located at the lower edge thereof whereby, with the sleeve element telescoped over the primary container lid, the locking slots in said main panels become engaged with the flanged portion of said primary container lid to retain the sleeve in position on said primary container and at the same time, create spaces at each end of said sleeve between the generally round edges of said primary container lid portion and the ends of the elliptically shaped sleeve for accomodating and retaining one or more promotional products with said primary container.

5. The display sleeve element of claim 4 wherein said blank includes a first abbreviated panel located between said main panels and foldably attached thereto and a second abbreviated panel located between one of said main panels and said glue flap and foldably attached thereto.

* * * * *